United States Patent [19]

Tivis

[11] Patent Number: 5,058,210

[45] Date of Patent: Oct. 22, 1991

[54] DISPOSABLE SWEAT LINER FOR SAFETY HATS

[76] Inventor: Victor L. Tivis, 253 Oklahoma Dr., Portales, N. Mex. 88130

[21] Appl. No.: 475,452

[22] Filed: Feb. 6, 1990

[51] Int. Cl.[5] ..... A42B 1/00

[52] U.S. Cl. ..... 2/181; 2/181.4; 2/DIG. 11

[58] Field of Search ..... 2/181, 181.4, 181.6, 2/182.4, 190, DIG. 11, 63

[56] References Cited

U.S. PATENT DOCUMENTS

| | | | |
|---|---|---|---|
| 1,651,015 | 11/1927 | Cohen | 2/190 |
| 2,131,697 | 9/1938 | Cavanagh | 2/181 |
| 2,783,474 | 3/1957 | Campagna | 2/181 |
| 3,089,146 | 5/1963 | Sterne | 2/181 |
| 3,578,736 | 5/1971 | Dootson | 2/181 |
| 4,394,782 | 7/1983 | Wasson | 2/181.4 |
| 4,468,817 | 9/1984 | Nunnery | 2/181 |
| 4,502,156 | 3/1985 | Wishman | 2/181 |
| 4,521,922 | 6/1985 | Mitchell | 2/DIG. 11 |
| 4,656,671 | 4/1987 | Manges | 2/DIG. 11 |
| 4,675,915 | 6/1987 | Siciliano | 2/DIG. 11 |
| 4,698,852 | 10/1987 | Romero | 2/DIG. 11 |
| 4,742,581 | 5/1988 | Rosenthal | 2/181 |
| 4,833,734 | 5/1989 | Der Estephanian | 2/181 |
| 4,856,116 | 8/1989 | Sullivan | 2/DIG. 11 |
| 4,941,210 | 7/1990 | Konucik | 2/181.4 |
| 4,958,385 | 9/1990 | Rushton | 2/181 |

FOREIGN PATENT DOCUMENTS

| | | | |
|---|---|---|---|
| 569860 | 2/1959 | Canada | 2/181 |
| 645112 | 10/1950 | United Kingdom | 2/181 |

*Primary Examiner*—Werner H. Schroeder
*Assistant Examiner*—Diana L. Biefeld

[57] ABSTRACT

The disposable sweat liner for safety hats (hard hats) provides both comfort and safety for those individuals working in occupations requiring the wearing of this type of safety device. It may be replaced as often as desired by the user depending on the amount of perspiration generated on the forehead.

The liner is composed of layers of absorbent padding covered on the top and bottom with fabric which is bonded around the border of the sweat liner. A pressure-sensitive adhesive tab is located at each end and at the top center of the sweat liner which are attached to the existing plastic headband at each side and in the front. Each tab is long enough to wrap around the plastic or leather head-band and be attached to the sweat liner. The sweat liner will remain in place because it is between the wearer's forehead and the existing webbing in the safety hat.

This application of the disposable sweat liner covers the entire forehead of the wearer, and because of its absorbent qualities, will retain perspiration which would ordinarily fall into the individual's eyes.

10 Claims, 2 Drawing Sheets

DISPOSABLE SWEAT LINER FOR SAFETY HATS

BACKGROUND OF THE INVENTION

The field of this invention relates to those articles specifically designed to deter perspiration from obstructing the vision of the safety hat wearer during the performance of his or her duties.

Specific fabric selected for this design will have unique absorption qualities. One side of the fabric is unfused or bearded, while the other side of the fabric is fused. When moisture is introduced to the unfused or bearded side of the fabric, the moisture is absorbed and penetrates through the fused side. The fused side of the fabric does not allow the moisture to return to the unfused side. In this application, the unfused or bearded side of the fabric will be placed in such a manner that it will form the outside of this moisture-absorbing (perspiration) invention.

With the addition of the layers of absorbent padding between the top and bottom layers of above described fabric, the disposable sweat liner will retain more moisture or perspiration thereby reducing the frequency of changing and replacement of the disposable sweat liner.

The two outside layers of fabric, with the layers of absorbent padding between, are then heat-sealed around the edges with pressure-sensitive adhesive tabs attached by the same heat sealing process.

Previous inventions in this field would not be as efficient or sanitary as the one herein described because of:

1. The type of materials used in previous inventions, when saturated with perspiration, will not retain the perspiration, thus allowing the perspiration to fall into the wearer's eyes which defeats its purpose.
2. The materials in previous inventions tend to be bulky and uncomfortable to wear.
3. The design of the previous inventions would require laundering every day or during the summer months, several times each day.
4. The method of attaching the previous inventions to the headbands of the hard hats is cumbersome and time-consuming.

The disposable sweat liner for safety hats described in the application would be the solution in that it alleviates the four problems in the foregoing paragraph.

SUMMARY OF THE INVENTION

More and more industries are requiring their employees to wear safety hats or as they are more commonly called, "hard hats" in the performance of their duties. The hard hats must fit on the head in such a manner that perspiration will form around the existing headband of the hard hat and especially in the region of the forehead.

The principal object of this invention is to provide a functional yet inexpensive disposable device which will, because of its design and its component parts, absorb and retain perspiration effectively on the forehead of the wearer.

Another object of this invention is to protect the area of the brow and forehead where it comes in contact with the headband and webbing of the hard hat.

Another object of this invention is to absorb the perspiration of the wearer especially those working with high voltage electricity or heavy industrial machinery where obstructed vision caused by perspiration or pausing to clear the perspiration from the eyes could cause a serious accident or injury.

Another object of this invention is, because of its component parts, it will retain the perspiration.

A further object is its simplicity of design and ease of application to the hard hat, having only three pressure-sensitive tabs to attach to the headband of the hard hat.

A still further object is that the wearer doesn't have to be concerned with washing or otherwise cleaning and storing this design.

Other objects include simplicity of design, ease of use, inexpensive to manufacture and to purchase, and very efficient all of which will become apparent as the following detailed description is read in conjunction with the accompanying drawing.

In the accompanying drawings:

FIG. 1 is a flat drawing of the disposable sweat liner indicating the location of the three pressure-sensitive adhesive strips before application;

FIG. 2 is a perspective view of the disposable sweat liner of the invention, showing the correct positioning and attachment of the disposable sweat liner to the sweat band forming part of a safety hat, and illustrating the location of the pressure sensitive tabs as they appear after attachment to the sweat band (in full lines), and also as they appear prior to attachment to the sweat band (in dashed lines).

FIG. 3 indicates a side view partially in elevation and partially in cross section of the disposable sweat liner as it would be secured to the sweat band of the safety hat utilizing the pressure-sensitive adhesive tabs;

FIG. 5 indicates a cross-section view of the layers of absorbent padding covered top and bottom with fabric.

DETAILED DESCRIPTION OF A PREFERRED EMBODIMENT OF THE INVENTION

Figure 1:
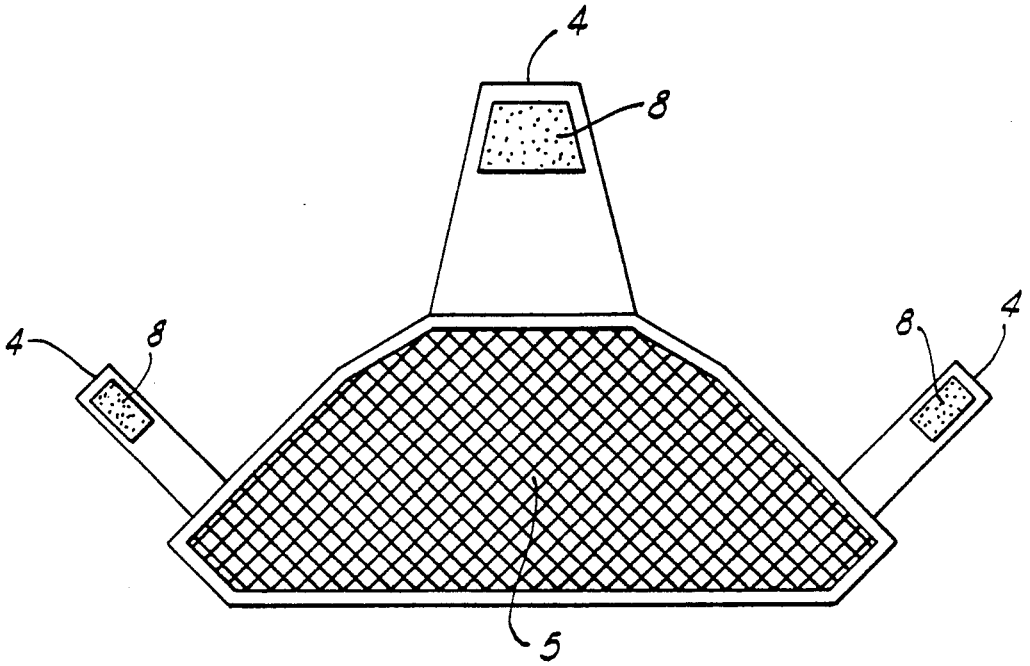

FIG. 1 indicates the configuration of the disposable sweat liner (5) prior to the application inside the safety hat noting the location of the three pressure-sensitive adhesive tabs (4) and that portion of said pressure-sensitive tabs to which pressure-sensitive adhesive material (8) has been applied.

Figure 2:
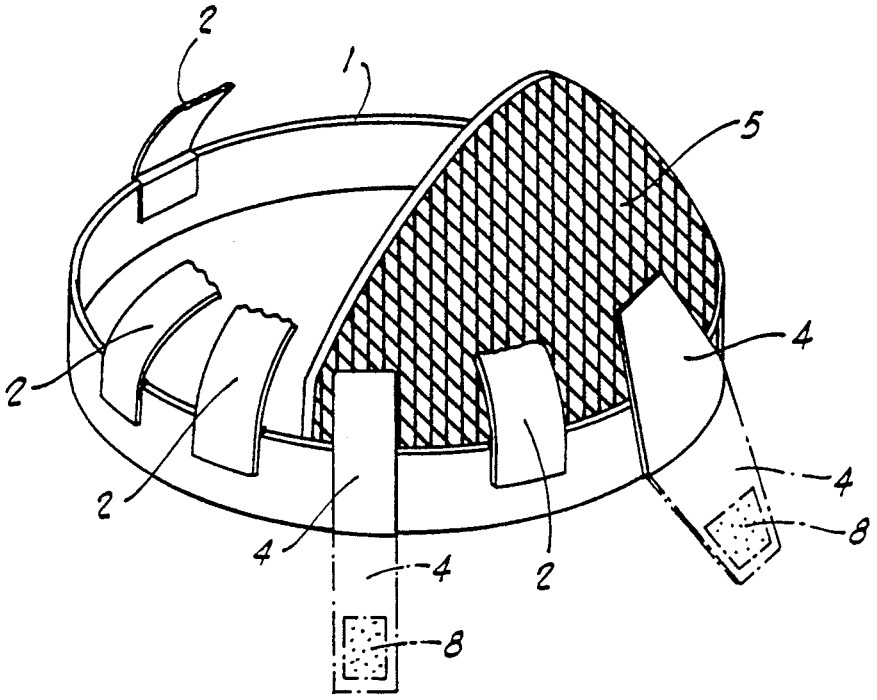

Referring to FIG. 2, the disposable sweat liner (5) prior to actually securing to the existing headband (1) of a safety hat and indicating the relationship of an disposable sweat liner (5) to the existing headband (1), and to the existing webbing (2) typically found in a safety hat (3).

Figure 3:
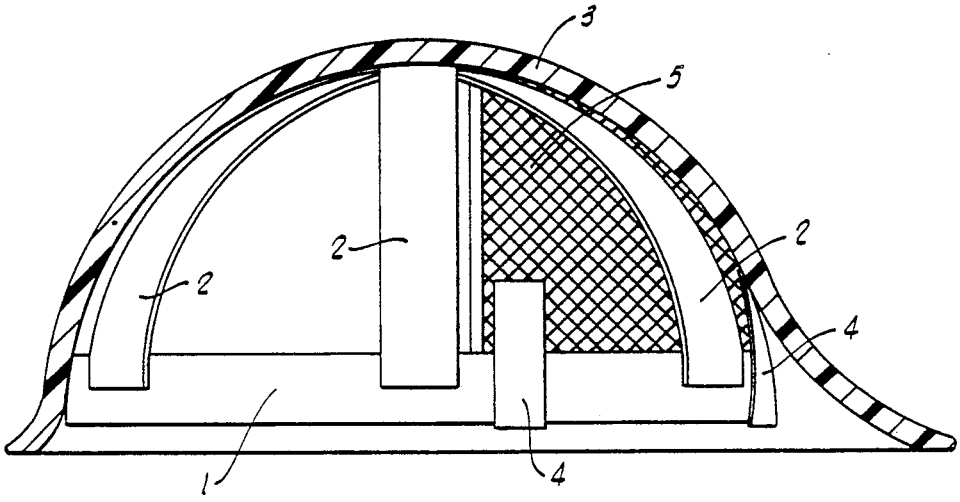

Referring to FIG. 3, the disposable sweat liner (5) is placed inside a front center portion of the headband (1) of the safety hat in such a manner that the pressure-sensitive adhesive tabs (4) carrying adhesive (8) are inside and adjacent to the existing headband (1), with a wider, trapazoidally shaped pressure-sensitive adhesive tab being positioned inside the front center of said headband causing the two narrower pressure-sensitive adhesive tabs to be positioned inside and on either side of the headband approximately above the wearer's temple. The bottom edge of the sweat liner (5) is positioned even with the bottom edge of the sweat band (1) in the safety hat.

Each of the pressure-sensitive adhesive tabs (4) is then be pulled under the existing sweat band (1), over the outer side of said sweat band and attached to the disposable sweat liner.

Figure 4:
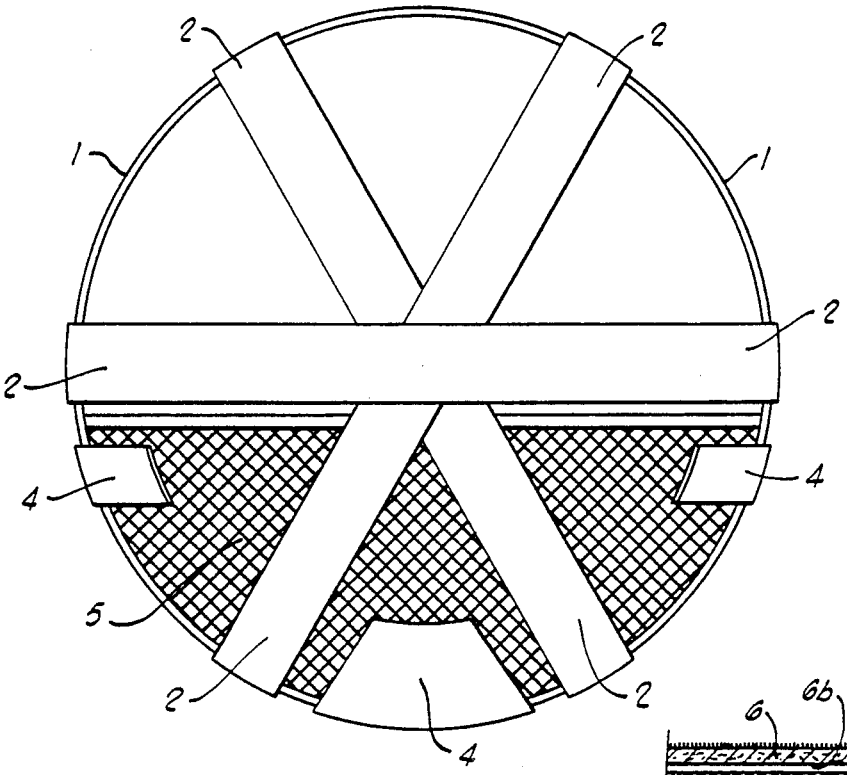
Figure 5:
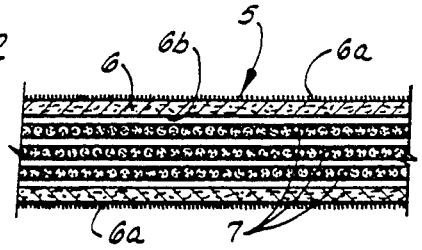

The top portion of the disposable sweat liner (5) is held in place by the wearer's forehead and the existing webbing (2) in the crown of the safety hat (3) as shown in FIG. 4 and FIG. 5.

FIG. 4 is a top plan view of the application of the disposable sweat liner (5) and the relation of said disposable sweat liner (5) to the headband (1) and crown webbing (2), FIG. 6 indicating a cut-away version with safety hat (3).

As shown in FIG. 5 a cross-sectional view of the disposable sweat liner, the sweat liner contains layers of absorbent padding (7) covered on the top and bottom by fabric (6). The outside covering of fabric (6) is assembled in such a manner that one side (6*a*) of the unfused or bearded side of the fabric will be that portion of the disposable sweat liner (5) which comes in contact with the wearer 3 s forehead and the other side 6*b* is the side facing inwardly toward the layers of padding.

It will be recognized that the foregoing is but one example of an apparatus and method within the scope of the invention and that various other modifications will occur to those skilled in the art upon reading the disclosure set forth herein before.

What is claimed is:

1. In a safety hat having an annular headband and having crown webbing, the improvement which comprises:

a disposable sweat liner adapted for detachable attachment to said annular headband carried in said safety hat, and for placement against the crown webbing of said safety hat for absorbing perspiration of the wearer of the safety hat, the sweat liner comprising:

a first, inner panel of moisture-retaining fabric having an inner side, an outer side and a peripheral edge, said peripheral edge including a generally curved portion adapted to mate with a first part of said annular sweat band of the safety hat, said first inner panel being fabricated to transfer moisture in one direction through said first inner panel from the outer side thereof to the inner side thereof, while resisting movement of moisture through the first inner panel in the opposite direction;

a second, outer panel having a peripheral edge connected to the peripheral edge of said first, inner panel, the peripheral edge of said second panel including a generally curved portion adapted to contact and mate with said part of said annular sweat band of said safety hat, said peripheral edges of said first and second panels being interconnected to define an enclosure between said first and second panels with the inner side of said first inner panel facing inwardly into the interior of the enclosure;

absorbent padding positioned between the inner and outer panels and in contact with the inner side of the inner panel; and flexible securement tabs connected to said inner and outer panels at spaced intervals along the portions of said first and second panels which are interconnected peripheral edges of said first and second panels and projecting outwardly therefrom to facilitate detachable securement to said annular headband.

2. A disposable sweat liner as defined in claim 1 wherein said first panel is polypropylene having its first, inner side fused and smooth, and having its outer side unfused and bearded to wick moisture from the outer side through the first panel to the inner side, and into contact with said absorbent padding.

3. A disposable sweat liner as defined in claim 1 wherein said absorbent padding is cellulosic material.

4. A disposable sweat liner as defined in claim 1 wherein said first and second panels are plastic, and wherein said peripheral edges of the first and second panels are connected to each other by thermally fusing them together while the absorbent padding is retained between the panels.

5. A disposable sweat liner as defined in claim 1 wherein said second, outer panel has an inner side and an outer side and is fabricated to transfer moisture in one direction through the panel from the outer side thereof to the inner side while resisting movement of moisture through the second panel in the opposite direction.

6. A disposable sweat liner as defined in claim 2 wherein said absorbent padding is a cellulosic material.

7. A disposable sweat liner as defined in claim 3 wherein said first and second panels are polypropylene.

8. A disposable sweat liner as defined in claim 3 wherein said second outer panel has an inner side and an outer side and is fabricated to transfer moisture in one direction through the panel from the outer side thereof to the inner side, while resisting movement of moisture through the second panel in the opposite direction.

9. A disposable sweat liner as defined in claim 3 wherein said first panel is polypropylene having its inner side fused and smooth and having its outer side unfused and bearded to wick moisture from the outer side through the first panel to the inner side into contact with said absorbent padding.

10. In combination:

a hard rigid safety hat defining an opening for the head of the wearer at one side thereof;

an annular head band extending around the interior of the hat and surrounding said opening into the hat;

crown webbing connected to the headband and extending upwardly into the crown of the hat in a dome-like configuration; and a sweat liner connected to the headband and bearing against the crown webbing at a location adjacent the forward and upper side of the hat, said sweat liner including:

a first, inner panel having an inner side and an outer side and a peripheral edge, said first, inner panel being permeable to the migration of perspiration from said outer side to said inner side;

a second, outer panel having a peripheral edge connected to the peripheral edge of said first inner panel so that said second outer panel defines an enclosure with said first inner panel, with the inner side of said inner panel facing inwardly into the interior of the enclosure;

an absorbent material positioned between the inner and outer panels in said enclosure; and flexible securement tabs connected to said panels at spaced intervals along the connected peripheral edges thereof, each of said flexible securement tabs extending around, and engaging said annular headband to retain said sweat liner in a position to bear against the crown webbing at said location adjacent the forward and upper side of the hat, and the end part of each of said tabs passing between said headband and said hat to facilitate retention of said sweat liner as said headband is forced outwardly toward said hat when the hat is worn.

* * * * *